US006780557B2

(12) United States Patent
Kawaji et al.

(10) Patent No.: US 6,780,557 B2
(45) Date of Patent: Aug. 24, 2004

(54) TONER

(75) Inventors: Hiroyuki Kawaji, Wakayama (JP); Tetsuya Ueno, Wakayama (JP); Yasunori Inagaki, Wakayama (JP)

(73) Assignee: Kao Corporation, Tokyo (JP)

( * ) Notice: Subject to any disclaimer, the term of this patent is extended or adjusted under 35 U.S.C. 154(b) by 0 days.

(21) Appl. No.: 10/256,078

(22) Filed: Sep. 27, 2002

(65) Prior Publication Data

US 2003/0096184 A1 May 22, 2003

(30) Foreign Application Priority Data

Sep. 28, 2001 (JP) ..... 2001-304032

(51) Int. Cl.[7] ..... G03G 9/087

(52) U.S. Cl. ..... 430/109.3; 430/109.4; 430/106.1

(58) Field of Search ..... 430/109.3, 106.1, 430/109.4

(56) References Cited

U.S. PATENT DOCUMENTS

| | | | | |
|---|---|---|---|---|
| 5,483,016 | A | 1/1996 | Aoki et al. | |
| 6,288,166 | B1 * | 9/2001 | Sata et al. | 525/69 |
| 6,383,705 | B2 | 5/2002 | Aoki et al. | |
| 6,582,869 | B2 * | 6/2003 | Daimon et al. | 430/109.4 |

FOREIGN PATENT DOCUMENTS

| | | | |
|---|---|---|---|
| JP | 49129540 | A | 12/1974 |
| JP | 87039428 | B | 8/1987 |
| JP | 93044029 | B | 7/1993 |
| JP | 11249339 | A | 9/1999 |
| JP | 2001222138 | A | 8/2001 |

* cited by examiner

*Primary Examiner*—John L Goodrow
(74) *Attorney, Agent, or Firm*—Birch, Stewart, Kolasch & Birch, LLP

(57) ABSTRACT

A toner comprising a resin binder comprising a crystalline resin having a ratio of a softening point to a maximal peak temperature of heat of fusion of 0.6 or more and less than 1.1, and an amorphous hybrid resin having a ratio of a softening point to a maximal peak temperature of heat of fusion of from 1.1 to 4.0; and a colorant, wherein the amorphous hybrid resin comprises two polymerization resin components each having an independent reaction path, said two polymerization resin components being partially chemically bonded to each other, wherein at least one polymerization resin component is the same as that of the crystalline resin, and wherein a weight ratio of the crystalline resin to the amorphous hybrid resin (crystalline resin/amorphous hybrid resin) is from 1/99 to 50/50. The toner can be used for developing electrostatic latent images formed in electrophotography, electrostatic recording method, electrostatic printing, and the like.

12 Claims, No Drawings

TONER

This nonprovisional application claims priority under 35 U.S.C. §119(a) on Patent Application No. 2001-304032 filed in JAPAN on Sep. 28, 2001, which is herein incorporated by reference.

BACKGROUND OF THE INVENTION

1. Field of the Invention

The present invention relates to a toner used for developing electrostatic latent images formed in electrophotography, electrostatic recording method, electrostatic printing method, and the like.

2. Discussion of the Related Art

In order to aim for improvement in the low-temperature fixing ability, one of the major problems in electrophotography, there has been studied a toner comprising a resin binder comprising a crystalline polyester (Japanese Patent Laid-Open No. Sho 49-129540 (GB-A-1449363) and the like). However, while the crystalline polyester has an excellent low-temperature fixing ability, the crystalline polyester worsens the pulverizability, the storage ability, the triboelectric stability and the like of the resulting toner when used alone.

In view of this, Japanese Examined Patent Publication No. Hei 5-44029 discloses a toner in which a crystalline polyester is used together with an amorphous resin. However, in this toner, since the backbones of both resins are different, the dispersibility of the crystalline polyester is insufficient, so that there is little effect for improvements in the fixing ability and the storage ability of the toner, and the triboelectric stability also becomes insufficient.

In addition, when the backbones of a crystalline polyester and an amorphous polyester are almost the same, as in the toner disclosed in Japanese Examined Patent Publication No. Sho 62-39428, the dispersibility of the crystalline polyester is so high that a large amount of the crystalline polyester exposed on the surface of the toner causes worsening of the pulverizability and the storage ability.

Further, a combined use of the crystalline polyester with the amorphous polyester has been studied as disclosed in Japanese Patent Laid-Open No. 2001-222138 (U.S. Pat. No. 6,383,705) and Japanese Patent Laid-Open No. Hei 11-249339. In such toners, although an improvement in the low-temperature fixing ability is acknowledged to some extent, further improvements are earnestly desired in the pulverizability, the storage ability and the environmental stability.

An object of the present invention is to provide a toner excellent in all of the pulverizability, the low-temperature fixing ability and the storage ability, and also excellent in the environmental stability.

These and other objects of the present invention will be apparent from the following description.

SUMMARY OF THE INVENTION

According to the present invention, there is provided a toner comprising:

a resin binder comprising:

a resin having a ratio of a softening point to a maximal peak temperature of heat of fusion of 0.6 or more and less than 1.1 (hereinafter referred to as "crystalline resin"), and a hybrid resin having a ratio of a softening point to a maximal peak temperature of heat of fusion of from 1.1 to 4.0 (hereinafter referred to as "amorphous hybrid resin"); and a colorant, wherein the amorphous hybrid resin comprises two polymerization resin components each having an independent reaction path, the two polymerization resin components being partially chemically bonded to each other, wherein at least one of the reaction path of the polymerization resin component is the same as that of the crystalline resin, and wherein a weight ratio of the crystalline resin to the amorphous hybrid resin (crystalline resin/amorphous hybrid resin) is from 1/99 to 50/50.

DETAILED DESCRIPTION OF THE INVENTION

In the present invention, since a crystalline resin and an amorphous hybrid resin are used in combination, the pulverizability, the storage ability, and the environmental stability in triboelectric charges are remarkably improved as compared to conventional toners containing a crystalline resin.

Specifically, the amorphous hybrid resin comprises two polymerization resin components each having an independent reaction path, the two polymerization resin components being partially chemically bonded to each other, wherein at least one of the reaction path of the polymerization resin component is the same as that of the crystalline resin. Therefore, the dispersion state of the crystalline resin can be easily adjusted. As a result, the crystalline resin can maintain an appropriate dispersion state in a toner, without being exceedingly compatible with the amorphous hybrid resin, whereby the pulverizability, the storage ability and the triboelectric stability can be improved without worsening the fixing ability.

The weight ratio of the crystalline resin to the amorphous hybrid resin (crystalline resin/amorphous hybrid resin) is from 1/99 to 50/50, preferably from 3/97 to 40/60, more preferably from 5/95 to 30/70.

The crystalline resin includes crystalline polyesters, crystalline polyester-polyamides, crystalline polyamides, and the like. Among them, the crystalline polyester is preferable, from the viewpoint of the fixing ability and the compatibility with the amorphous hybrid resin.

In the present invention, the crystalline polyester is preferably a resin obtained by polycondensing an alcohol component comprising 80% by mol or more of an aliphatic diol having 2 to 6 carbon atoms, preferably 4 to 6 carbon atoms, with a carboxylic acid component comprising 80% by mol or more of an aliphatic dicarboxylic acid compound having 2 to 8 carbon atoms, more preferably 4 to 6 carbon atoms, more preferably 4 carbon atoms.

The aliphatic diol having 2 to 6 carbon atoms includes ethylene glycol, 1,2-propylene glycol, 1,3-propylene glycol, 1,4-butanediol, 1,5-pentanediol, 1,6-hexanediol, neopentyl glycol, 1,4-butenediol, and the like, among which α, ω-linear alkyl diol is preferable, and 1,4-butanediol and 1,6-hexanediol are more preferable.

It is desirable that the aliphatic diol having 2 to 6 carbon atoms is contained in the alcohol component in an amount of 80% by mol or more, preferably from 85 to 100% by mol, more preferably from 90 to 100% by mol. Especially, it is desirable that one aliphatic diol constitutes 70% by mol or more, preferably 80% by mol or more, more preferably from 85 to 95% by mol of the alcohol component.

The alcohol component may contain a polyhydric alcohol component other than the aliphatic diol having 2 to 6 carbon atoms. Such a polyhydric alcohol component includes a divalent aromatic alcohol such as an alkylene(2 to 3 carbon atoms) oxide adduct (average number of moles added being 1 to 10) of bisphenol A, such as polyoxypropylene(2.2)-2,2-bis(4-hydroxyphenyl)propane and polyoxyethylene(2.2)-2,2-bis(4-hydroxyphenyl)propane; a trihydric or higher polyhydric alcohol component such as glycerol, pentaerythritol and trimethylolpropane; and the like.

The aliphatic dicarboxylic acid compound having 2 to 8 carbon atoms includes oxalic acid, malonic acid, maleic acid, fumaric acid, citraconic acid, itaconic acid, glutaconic acid, succinic acid, adipic acid, acid anhydrides thereof, alkyl(1 to 3 carbon atoms) esters thereof, and the like, among which fumaric acid is preferable. Incidentally, as described above, the aliphatic dicarboxylic acid compound refers to aliphatic dicarboxylic acids, acid anhydrides thereof and alkyl(1 to 3 carbon atoms) esters thereof, among which aliphatic dicarboxylic acids are preferable.

It is desirable that the aliphatic dicarboxylic acid compound having 2 to 8 carbon atoms is contained in the carboxylic acid component in an amount of 80% by mol or more, preferably from 85 to 100% by mol, more preferably from 90 to 100% by mol. Especially, it is desirable that one aliphatic dicarboxylic acid compound constitutes 60% by mol or more, preferably 80% by mol or more, preferably from 85 to 100% by mol, of the carboxylic acid component. Among them, from the viewpoint of the storage ability of the crystalline polyester, it is desirable that fumaric acid is contained in the carboxylic acid component in an amount of preferably 60% by mol or more, preferably 70 to 100% by mol, especially preferably from 80 to 100% by mol.

The carboxylic acid component may contain a polycarboxylic acid component other than the aliphatic dicarboxylic acid compound having 2 to 8 carbon atoms. Such a polycarboxylic acid component includes aromatic dicarboxylic acids such as phthalic acid, isophthalic acid and terephthalic acid; aliphatic dicarboxylic acids such as sebacic acid, azelaic acid, n-dodecylsuccinic acid and n-dodecenylsuccinic acid; alicyclic carboxylic acids such as cyclohexanedicarboxylic acid; tricarboxylic or higher polycarboxylic acids such as 1,2,4-benzenetricarboxylic acid (trimellitic acid) and pyromellitic acid; acid anhydrides thereof, alkyl(1 to 3 carbon atoms) esters thereof, and the like.

The polycondensation of the alcohol component with the carboxylic acid component can be carried out, for instance, by the reaction at a temperature of from 120° to 230° C. in an inert gas atmosphere, using an esterification catalyst and a polymerization inhibitor as occasion demands. Concretely, in order to enhance the strength of the resin, an entire monomer may be charged at once. Alternatively, in order to reduce the low-molecular weight components, divalent monomers are firstly reacted, and thereafter trivalent or higher polyvalent monomers are added and reacted. In addition, the reaction may be accelerated by reducing the pressure of the reaction system in the second half of the polymerization.

Here, in the present invention, the term "crystalline" means that a ratio of the softening point to the maximum peak temperature of heat of fusion (softening point/maximum peak temperature of heat of fusion) is from 0.6 or more and less than 1.1, preferably from 0.9 or more and less than 1.1, more preferably from 0.98 to 1.05. Also, the term "amorphous" means that a ratio of the softening point to the maximum peak temperature of heat of fusion (softening point/maximum peak temperature of heat of fusion) is from 1.1 to 4.0, preferably from 1.5 to 3.0.

The crystalline resin has a softening point of preferably from 85° to 150° C., more preferably from 90° to 140° C., still more preferably from 100° to 135° C. In addition, the crystalline resin has a maximum peak temperature of heat of fusion of preferably from 77° to 166° C., more preferably from 82° to 155° C., especially preferably from 91° to 150° C.

Similarly, the crystalline polyester has a softening point of preferably from 85° to 150° C., more preferably from 90° to 140° C., still more preferably from 100° to 135° C. In addition, the crystalline polyester has a maximum peak temperature of heat of fusion of preferably from 77° to 166° C., more preferably from 82° to 155° C., especially preferably from 91° to 150° C.

Incidentally, in the case where the crystalline polyester comprises two or more resins, it is desirable that at least one of them, preferably all of them, is the crystalline polyester described above.

In the present invention, the hybrid resin in which two polymerization resin components each having independent reaction paths are partially chemically bonded to each other may be obtained by using two or more resins as raw materials, or it may be obtained by using one resin and raw material monomers of the other resin. Further, the hybrid resin may be obtained from a mixture of raw material monomers of two or more resins. In order to efficiently obtain a hybrid resin, those obtained from a mixture of raw material monomers of two or more resins are preferable. As described above, at least one of the resin component comprising a hybrid resin is the same polymerization resin composition as the crystalline resin, from the viewpoint of the compatibility with the crystalline resin.

Therefore, it is preferable that the hybrid resin is obtained by mixing raw material monomers of two polymerization resins each having independent reaction paths, preferably raw material monomers for the condensation polymerization resin and raw material monomers for the addition polymerization resin, and carrying out the two polymerization reactions.

Representative examples of the condensation polymerization resin include polyesters, polyester-polyamides, polyamides, and the like. Representative examples of the addition polymerization resin include vinyl resins obtained by radical polymerization, and other resins.

The raw material monomer for the polyester includes dihydric or higher polyhydric alcohols and dicarboxylic acid or higher polycarboxylic acid compounds. Here, in order to prepare an amorphous polyester, it is preferable that the following requirements are met:

1) in a case where monomers for accelerating crystallization of a resin, such as an aliphatic diol having 2 to 6 carbon atoms and an aliphatic dicarboxylic compound having 2 to 8 carbon atoms, are used, a resin in which crystallization is suppressed by using two or more of these monomers in combination, in each of the alcohol component and the carboxylic acid component, at least one of these monomers is used in an amount of from 10 to 70% by mol, preferably 20 to 60% by mol of each component, and these monomers are used in two or more kinds, preferably two to four kinds; or 2) a resin obtained from monomers for accelerating amorphousness of a resin, preferably an alkylene oxide adduct of bisphenol A as an alcohol component, or a substituted succinic acid of which substituent is an alkyl group or alkenyl group as a carboxylic acid component are used in an amount of from 30 to 100% by mol, preferably from 50 to 100% by mol, of the alcohol component or the carboxylic acid component, preferably of the alcohol component and the carboxylic acid component, respectively.

In addition, the raw material monomer for forming the amide component of the polyester-polyamide or the polyamide includes various known polyamines, aminocarboxylic acids and amino alcohols, and hexamethylenediamine and ε-caprolactam are preferred.

The raw material monomer for the vinyl resin includes styrenic compounds such as styrene and α-methylstyrene; ethylenically unsaturated monoolefins such as ethylene and propylene; diolefins such as butadiene; vinyl halides such as vinyl chloride; vinyl esters such as vinyl acetate and vinyl propionate; esters of ethylenic monocarboxylic acids such as alkyl(1 to 18 carbon atoms) esters of (meth)acrylic acid and dimethylaminoethyl (meth)acrylate; vinyl ethers such as vinyl methyl ether; vinylidene halides such as vinylidene chloride; N-vinyl compounds such as N-vinylpyrrolidone; and the like. It is desired that styrene and/or the alkyl ester of (meth)acrylic acid is contained in an amount of 50% by weight or more, preferably from 80 to 100% by weight of the raw material monomer for the vinyl resin, from the viewpoints of the reactivity, the pulverizability and the triboelectric stability.

When the raw material monomers for the vinyl resin are polymerized, a polymerization initiator, a crosslinking agent, or the like may be used, if necessary.

In the present invention, it is desired that the weight ratio of the condensation polymerization resin component to the addition polymerization resin component, i.e. the weight ratio of the raw material monomer for the condensation polymerization resin unit to the raw material monomer for the addition polymerization resin unit, is usually from 50/50 to 95/5, preferably from 60/40 to 95/5, because it is preferable that the continuous domain is the condensation polymerization resin, from the viewpoint of the offset resistance.

As the amorphous hybrid resin in the present invention, a resin obtained by mixing a monomer capable of reacting with both of the raw material monomers for the two polymerization resins (dually reactive monomer) as one of the raw material monomers with the mixture of raw material monomers of two polymerization resins each having independent reaction paths is preferable.

It is preferable that the dually reactive monomer is a monomer having at least one functional group selected from the group consisting of hydroxyl group, carboxyl group, epoxy group, a primary amino group and a secondary amino group, and an ethylenically unsaturated bond in the molecule. The dispersibility of the resin forming the dispersed phase can be improved by using the dually reactive monomer described above. Concrete examples of the dually reactive monomer include, for instance, acrylic acid, fumaric acid, methacrylic acid, citraconic acid, maleic acid, and the like. Among them, acrylic acid, methacrylic acid and fumaric acid are preferred.

The amount of the dually reactive monomer used is preferably from 0.1 to 10 parts by weight based on 100 parts by weight of the raw material monomer for the condensation polymerization resin. Here, in the present invention, the dually reactive monomer is considered as a separate monomer from the raw material monomers for the condensation polymerization resin and the raw material monomers for the addition polymerization resin, owing to the specificity of the properties of the dually reactive monomer.

In the present invention, when the hybrid resin is obtained by carrying out the two polymerization reactions using a mixture of the raw material monomers and the dually reactive monomer described above, the polymerization reactions do not necessarily progress or terminate simultaneously, and each of the reactions may be progressed or terminated by appropriately selecting the reaction temperature and reaction time depending upon each of the reaction mechanisms.

For instance, a preferred process for preparing the hybrid resin in the present invention comprises mixing a raw material monomer for a condensation polymerization resin, a raw material monomer for an addition polymerization resin, a dually reactive monomer, a catalyst such as a polymerization initiator, and the like; mainly carrying out radical polymerization reaction at 50° to 180° C., to firstly give an addition polymerization resin component having a functional group reactive for a subsequent condensation polymerization reaction; raising the reaction temperature to 190° to 270° C.; and mainly carrying out condensation polymerization reaction to form a condensation polymerization resin component.

It is desired that the amorphous hybrid resin has a softening point of from 80° to 170° C., preferably from 90° to 160° C., still more preferably from 95° to 155° C.

It is desired that the weight ratio of the crystalline polyester to the above amorphous hybrid resin (crystalline polyester/amorphous hybrid resin) is from 1/99 to 50/50, preferably from 3/97 to 40/60, more preferably from 5/95 to 30/70.

The resin binder may contain other resins such as an amorphous polyester, a styrene-acrylic resin, an epoxy resin, a polycarbonate, a polyurethane or the like.

As the colorant, all of the dyes and pigments which are used as colorants for a toner can be used, and the colorant includes black colorants such as carbon blacks and composite metal oxides; colored colorants such as Phthalocyanine Blue, Permanent Brown FG, Brilliant Fast Scarlet, Pigment Green B, Rhodamine-B Base, Solvent Red 49, Solvent Red 146, Solvent Blue 35, quinacridone, carmine 6B, and disazoyellow. These colorants can be used alone or in admixture of two or more kinds. The toner of the present invention can be used as any of black toners, monochromatic toners, and full color toners. The content of the colorant is preferably from 1 to 40 parts by weight, more preferably from 3 to 10 parts by weight, based on 100 parts by weight of the resin binder.

In the present invention, it is preferable that a wax is contained, from the viewpoint of the fixing ability.

The wax includes, for instance, polyolefin waxes such as polypropylene waxes, polyethylene waxes, polypropylene-polyethylene copolymer waxes and Fischer-Tropsch wax; ester waxes such as carnauba wax, haze wax, beeswax, spermaceti wax, montan wax, and rice wax; amide waxes such as fatty acid amide waxes; and the like. These waxes may be contained alone or in admixture of two or more kinds. Among these waxes, Fischer-Tropsch wax and carnauba wax are preferable, from the viewpoints of the fixing ability and the storage ability, and Fischer-Tropsch wax is more preferable from the viewpoint of the dispersibility of the wax.

The content of the wax is preferably from 0.1 to 20 parts by weight, more preferably from 0.5 to 10 parts by weight, based on 100 parts by weight of the resin binder.

The wax may be contained in the toner by melt-kneading together with a resin binder. It is preferable that the wax is finely dispersed in the amorphous hybrid resin, from the viewpoints of the pulverizability and the storage ability, and it is more preferable that the wax is added to the reaction mixture together with the raw material monomers such as raw material monomers of the condensation polymerization resin and raw material monomers of the addition polymerization resin in the stage of the preparation of the amorphous hybrid resin.

Further, the toner of the present invention may appropriately contain an additive such as a charge control agent, a releasing agent, an electric conductivity modifier, an extender, a reinforcing filler such as a fibrous substance, an antioxidant, an anti-aging agent, a fluidity improver, or a cleanability improver.

The toner of the present invention is preferably a pulverized toner obtained by a kneading-pulverization method, which is, for instance, prepared by the step comprising homogeneously mixing a resin binder, a colorant or the like in a mixer such as a Henschel mixer or a ball-mill, thereafter melt-kneading the mixture with a closed kneader, a single-screw or twin-screw extruder, a continuous-type double roller kneader or the like, cooling, pulverizing and classifying the product. Further, a fluidity improver or the like may be added to the surface of the toner as occasion demands. The volume-average particle size of the toner thus obtained is preferably from 3 to 15 $\mu$m.

Since the toner of the present invention has excellent fixing ability even when it is a magnetic toner, a magnetic material may be contained as a colorant.

The magnetic material includes alloys such as magnetite, hematite and ferrite; ferromagnetic metal powders of iron, cobalt and nickel; and the like. It is preferable that the amount of the magnetic material is from 30 to 200 parts by weight, based on 100 parts by weight of the resin binder. When the toner contains a magnetic material, the toner can be used as a black toner, so that other colorant may not be necessarily contained.

The toner of the present invention not containing a magnetic material can be used as a nonmagnetic monocomponent developer or the toner can be mixed with a carrier and used as a two-component developer.

EXAMPLES

[Softening Point]

Softening point refers to a temperature corresponding to ½ of the height (h) of the S-shaped curve showing the relationship between the downward movement of a plunger (flow length) and temperature, namely, a temperature at which a half of the resin flows out, when measured by using a flow tester of the "koka" type ("CFT-500D," commercially available from Shimadzu Corporation) in which a 1 g sample is extruded through a nozzle having a dice pore size of 1 mm and a length of 1 mm, while heating the sample so as to raise the temperature at a rate of 6° C./min and applying a load of 1.96 MPa thereto with the plunger.

[Maximum Peak Temperature of Heat of Fusion and Glass Transition Point]

The maximum peak temperature of heat of fusion is determined using a differential scanning calorimeter ("DSC Model 210," commercially available from Seiko Instruments, Inc.), by raising its temperature to 200° C., cooling the hot sample to 0° C. at a cooling rate of 10° C./min., and thereafter heating the sample so as to raise the temperature at a rate of 10° C./min. In addition, the glass transition point characteristically owned by an amorphous resin refers to the temperature of an intersection of the extension of the baseline of equal to or lower than the maximum peak temperature and the tangential line showing the maximum inclination between the kickoff of the peak and the top of the peak by the determination mentioned above.

Preparation Examples of Crystalline Polyester

Raw material monomers listed in Table 1 and 2 g of hydroquinone were reacted at 160° C. over a period of 5 hours under nitrogen atmosphere. Thereafter, the temperature was raised to 200° C., and the ingredients were reacted for 1 hour and further reacted at 8.3 kPa for 1 hour. The resulting resins are referred to as Resins a and b.

TABLE 1

| | Resin a | Resin b |
|---|---|---|
| 1,4-Butanediol | 1520 g (90) | 1350 g (100) |
| 1,6-Hexanediol | 222 g (10) | |
| Fumaric Acid | 2175 g (100) | 1566 g (90) |
| Trimellitic Anhydride | | 288 g (10) |
| Softening Point (° C.) | 122.5 | 121.3 |
| Maximum Peak Temperature (° C.) of Heat of Fusion | 125.3 | 122.6 |

Note) Amounts within the parentheses express molar percentages for each of alcohol component and carboxylic acid component.

Preparation Example 1 of Amorphous Hybrid Resin

A mixture of raw material monomers for addition polymerization resin, a dually reactive monomer, and a wax each listed in Table 2, and 50 g of di-tert-butyl peroxide as a polymerization initiator was added dropwise to a mixture of raw material monomers for condensation polymerization resin listed in Table 2 and 4 g of dibutyltin oxide at 160° C. over a period of 1 hour. Thereafter, the monomers were further subjected to addition polymerization at 160° C. for 1 hour. Subsequently, the temperature of the reaction mixture was raised to 230° C. and the mixture was subjected to condensation polymerization reaction. With properly reducing the pressure of the reaction system, the reaction was terminated at a point where a given softening point was reached. The resulting resins are referred to as Resins A to C and E. The wax had an average dispersion diameter in Resin B of 4.5 $\mu$m.

Preparation Example 2 of Amorphous Hybrid Resin

A mixture of raw material monomers for addition polymerization resin and a dually reactive monomer each listed in Table 2, and 50 g of di-tert-butyl peroxide as a polymerization initiator was added dropwise to a mixture of raw material monomers for condensation polymerization resin and a wax each listed in Table 2 and 4 g of dibutyltin oxide at 160° C. over a period of 1 hour. Thereafter, the monomers were further subjected to addition polymerization at 160° C. for 1 hour. Subsequently, the temperature of the reaction mixture was raised to 230° C., and the mixture was subjected to condensation polymerization reaction. With properly reducing the pressure of the reaction system, the reaction was terminated at a point where a given softening point was reached. The resulting resins are referred to as Resin F and G. The wax had an average dispersion diameter in Resin F of 4.1 $\mu$m, and the wax had an average dispersion diameter in Resin G of 4.2 $\mu$m.

Preparation Example of Amorphous Polyester

Raw material monomers for condensation polymerization resin shown in Table 2 and 6.5 g of dibutyltin oxide were reacted at 230° C. under nitrogen atmosphere, with properly reducing pressure of the reaction system until a given softening point is reached, to give Resin D.

TABLE 2

| | Resin A | Resin B | Resin C | Resin D | Resin E | Resin F | Resin G |
|---|---|---|---|---|---|---|---|
| Raw Material Monomers for Condensation Polymerization Resin | | | | | | | |
| BPA-PO[1)] | 875 | 1225 | 1225 | 1225 | 1715 | 1225 | 1225 |
| BPA-EO[2)] | 813 | 488 | 488 | 488 | 683 | 488 | 488 |
| Terephthalic Acid | 466 | 340 | 340 | 340 | 833 | 365 | 340 |
| Trimellitic Anhydride | 314 | 197 | 197 | 197 | 138 | 234 | 197 |
| Dodecenylsuccinic Acid Anhydride | | 412 | 412 | 412 | 384 | | 412 |
| Adipic Acid | | | | | | 143 | |
| Dually Reactive Monomer | | | | | | | |
| Acrylic Acid | 17 | 35 | 35 | | | 35 | 35 |
| Raw Material Monomers for Addition Polymerization Resin | | | | | | | |
| Styrene | 449 | 500 | 500 | | 681 | 469 | 500 |
| 2-Ethylhexyl Acrylate | 99 | 110 | 110 | | 150 | 89 | 110 |
| Wax | | | | | | | |
| Fischer-Tropsch Wax "SP-105" commercially available from Sazole | | 165[3)] | | | | 154[3)] | 165[3)] |
| Softening Point (° C.) | 131.3 | 128.8 | 130.5 | 133.4 | 115.1 | 135.4 | 128.5 |
| Glass Transition Point (° C.) | 62.1 | 56.5 | 58.5 | 62.5 | 61.3 | 63.1 | 56.1 |

Note) Amount used is expressed by "g."
1) Polyoxypropylene(2.2)-2,2-bis(4-hydroxyphenyl)propane
2) Polyoxyethylene(2.2)-2,2-bis(4-hydroxyphenyl)propane
3) 5 parts by weight based on 100 parts by weight of entire raw material monomers

Examples 1 to 8 and Comparative Examples 1 to 4

A resin binder, a colorant, a charge control agent, a magnetic powder and a wax, each listed in Table 3, were previously mixed together with a Henschel mixer. Thereafter, the mixture was melt-kneaded with a twin-screw extruder, cooled and pulverized and classified, to give a powder having a volume-average particle size of 9 μm. During the pulverization step, coarse powder which was 16-mesh sieve-pass (sieve-opening: 1.0 mm) but 22-mesh sieve-on (sieve-opening: 0.710 mm) was subjected to Test Example 1 described below.

To 100 parts by weight of the resulting powder was added 0.3 parts by weight of a hydrophobic silica "HVK2150" (commercially available from Clariant Japan), and mixed with a Henschel mixer, to give a toner.

Test Example 1

The pulverizability was evaluated in accordance with the following evaluation criteria using a pulverizability index of the coarse powder obtained in the preparation step of the toner.

The coarse powder was accurately weight in an amount of 20.00 g. The coarse powder was pulverized for 10 seconds with a coffee-mill (commercially available from PHILIPS, HR-2170), and thereafter the pulverized powder was sieved with a 30-mesh sieve (sieve-opening: 500 μm). The weight (A) g of the sieve-on coarse powder was accurately weighed, and the residual percentage was determined by the following equation:

$$\text{Residual Percentage} = \frac{(A)}{\text{Weight (20.00) of Course Powder Before Pulverization with Coffee-Mill}} \times 100$$

An average value of three runs of the determination for the residual percentage is defined as a pulverizability index. Here, the lower the pulverizability index, the more excellent the pulverizability of the toner in the preparation equipment. The results are shown in Table 3.

(Evaluation Criteria)

| | |
|---|---|
| ◎ | less than 30; |
| ○ | 30 or more and less than 50 |
| X | 50 or more |

Test Example 2a

Evaluation of Magnetic Toners (Examples 1 to 4, 7 and 8 and Comparative Examples 1 to 3 and 5)

A toner was loaded to a modified apparatus of a commercially available monochromatic copy machine "NP6045" (commercially available from Canon Inc., printing speed: 45 sheets/minute, A4 sheets), in which a temperature setting of a fixing roller can be arbitrarily varied. The development of fixed images was carried out, with sequentially raising the temperature of the fixing roller from 90° to 240° C. The low-temperature fixing ability was evaluated by the following method. The results are shown in Table 3.

[Low-Temperature Fixing Ability]

A sand-rubber eraser to which a load of 500 g was applied, the eraser having a bottom area of 15 mm×7.5 mm, was moved backward and forward five times over a fixed image formed by passing through the fixing device. The optical reflective density of the image before or after the eraser treatment was measured with a reflective densitometer "RD-915" commercially available from Macbeth Process Measurements Co. The temperature of the fixing roller at which the ratio of the optical density after the eraser treatment to the optical density before the eraser treatment initially exceeds 70% is defined as the lowest fixing temperature.

The low-temperature fixing ability is evaluated by the following evaluation criteria.

(Evaluation Criteria)

The lowest fixing temperature is:

| | |
|---|---|
| ◎ | lower than 130° C.; |
| ○ | 130° C. or higher and lower than 150° C.; and |
| X | 150° C. or higher. |

Test Example 2b

Evaluation of Nonmagnetic Toners (Examples 5 and 6 and Comparative Example 4)

Four parts by weight of a toner and 96 parts by weight of a silicon-coated ferrite carrier (commercially available from Kanto Denka Kogyo Co., Ltd., average particle size: 90 μm) were mixed for 10 minutes with a turbuler mixer, to give a developer.

Next, the resulting developer was loaded in a modified apparatus of a copy machine "AR-505" (commercially available from Sharp Corporation). The development of fixed images (2 cm×12 cm) was carried out, each image having an average image density of 1.4 as determined by a reflective densitometer "RD-915" commercially available from Macbeth Process Measurements Co., with sequentially raising the temperature of the fixing roller from 90° to 240° C. The low-temperature fixing ability was evaluated in the same manner as in Test Example 2a. The results are shown in Table 3.

Test Example 3

Five grams of a toner was placed in a cylindrical vessel, and allowed to stand at 50° C. for 72 hours. Thereafter, the stored toner was sieved with 200-mesh (sieve-opening: 75 μm), and the weight of the sieve-pass toner was weighed, and the storage ability was evaluated in accordance with the following evaluation criteria:

(Evaluation Criteria)

The amount of the sieve-pass toners is:

| | |
|---|---|
| ◎ | exceeding 90% by weight; |
| ○ | 80 to 90% by weight; |
| X | less than 80% by weight. |

The results are shown in Table 3.

Test Example 4

A toner was loaded in the same apparatus as in Test Examples 2a and 2b, and printing was carried out continuously for 100000 sheets with a printing ratio of 5% under environmental conditions of 35° C. and 85% RH. The number of printed sheets at which the background fog was generated was indicated, and the environmental stability of the fixed image was evaluated. The results are shown in Table 3.

TABLE 3

| | Example Nos. | | | | | | | | Comparative Example Nos. | | | |
|---|---|---|---|---|---|---|---|---|---|---|---|---|
| | 1 | 2 | 3 | 4 | 5 | 6 | 7 | 8 | 1 | 2 | 3 | 4 |
| Resin Binder | | | | | | | | | | | | |
| Resin a | 30 | 30 | | 20 | 30 | 30 | 20 | 20 | | 30 | 55 | |
| Resin b | | | 10 | | | | | | | | | |
| Resin A | 70 | | 90 | | 70 | | | | 100 | | 45 | 100 |
| Resin B | | | | 80 | | | | | | | | |
| Resin C | | 70 | | | | | | | | | | |
| Resin D | | | | | | | | | | 70 | | |
| Resin E | | | | | | 70 | | | | | | |
| Resin F | | | | | | | 80 | | | | | |
| Resin G | | | | | | | | | 80 | | | |
| Magnetic Material[1)] | 100 | 100 | 100 | 100 | | | 100 | 100 | 100 | 100 | 100 | |
| Charge Control Agent[2)] | 1.5 | 1.5 | 1.5 | 1.5 | 1.5 | 1.5 | 1.5 | 1.5 | 1.5 | 1.5 | 1.5 | |
| Charge Control Agent[3)] | | | | | | 1 | | | | | | |
| Colorant | | | | | | | | | | | | |
| Carbon Black[4)] | | | | | 4 | | | | | | 4 | |
| Cyan Pigment[5)] | | | | | | 4 | | | | | | |
| Polypropylene Wax[6)] | 2 | 2 | 2 | | 2 | | | 2 | 2 | 2 | 2 | |
| Carnauba Wax[7)] | | | | | | 2 | | | | | | |
| Pulverizability | ○ | ○ | ◎ | ◎ | ○ | ◎ | ◎ | ◎ | ◎ | X | X | ◎ |
| Low-Temperature Fixing Ability | ◎ | ◎ | ○ | ◎ | ◎ | ◎ | ◎ | ◎ | X | ◎ | ◎ | X |
| Storage Ability | ○ | ○ | ◎ | ◎ | ◎ | ◎ | ◎ | ◎ | ◎ | X | Δ | ◎ |
| Environmental Stability (Generation of Background Fog) | None | None | None | None | None | None | None | None | None | After 10000 sheets | After 500 sheets | None |

[1)]MTS-106HD, commercially available from Toda Kogyo

[2)]T-77, negatively chargeable charge control agent, commercially available from Hodogaya Chemical

[3)]LR-147, negatively chargeable charge control agent, commercially available from Nippon Carlit

[4)]Monarch 880: commercially available from Cabot Corp.

[5)]ECB-301: commercially available from DAINICHI SEIKA

[6)]Viscol 550P: commercially available from Sanyo Kasei

[7)]Carnauba wax C1: commercially available from Kato Yoko

It can be seen from the above results that the toners in Examples 1 to 8 are excellent in all of the pulverizability, the low-temperature fixing ability, the storage stability and the environmental stability. Especially in Example 4 where a wax is added in the stage of the preparation of the hybrid resin, excellent results for all evaluations were obtained despite a magnetic toner. On the other hand, the toners of Comparative Examples 1 and 4 without containing a crystalline polyester are poor in the low-temperature fixing ability, and the toner of Comparative Example 2 containing an amorphous polyester instead of an amorphous hybrid resin is poor in the pulverizability and the storage ability, because the crystalline polyester and the amorphous polyester are too much compatible to each other, and is also poor in the environmental stability of the image quality. Also, the toner of Comparative Example 3 containing a large amount of the crystalline polyester is poor in the pulverizability and the storage ability.

According to the present invention, a toner excellent in all of the pulverizability, the low-temperature fixing ability and the storage ability, and also excellent in the environmental stability can be provided.

The present invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

What is claimed is:

1. A toner comprising:

a resin binder comprising:

a crystalline resin having a ratio of a softening point to a maximal peak temperature of heat of fusion of 0.6 or more and less than 1.1, and an amorphous hybrid resin having a ratio of a softening point to a maximal peak temperature of heat of fusion of from 1.1 to 4.0; and a colorant, wherein said amorphous hybrid resin comprises two polymerization resin components, comprising a condensation polymerization resin component and an addition polymerization resin component, each having an independent reaction path, said two polymerization resin components being partially chemically bonded to each other, wherein at least one of the reaction path of the polymerization resin component is the same as that of the crystalline resin, and wherein a weight ratio of said crystalline resin to said amorphous hybrid resin (crystalline resin/amorphous hybrid resin) is from 1/99 to 50/50.

2. The toner according to claim 1, wherein the crystalline resin has a softening point of from 85° to 150° C., and wherein the amorphous hybrid resin has a softening point of from 80° to 170° C.

3. The toner according to claim 1, wherein the crystalline resin is a crystalline polyester.

4. The toner according to claim 3, wherein the crystalline polyester is obtained by polycondensing an alcohol component comprising 80% by mol or more of an aliphatic diol having 2 to 6 carbon atoms, and a carboxylic acid component comprising 80% by mol or more of an aliphatic dicarboxylic acid compound having 2 to 8 carbon atoms.

5. The toner according to claim 4, wherein the alcohol component comprises 70% by mol or more of one aliphatic diol having 2 to 6 carbon atoms, and the carboxylic acid component comprises 60% by mol or more of one aliphatic dicarboxylic acid compound having 2 to 8 carbon atoms.

6. The toner according to claim 1, wherein the amorphous hybrid resin is obtained by a process comprising mixing raw material monomers for two polymerization resins, said monomers comprising raw material monomers for a condensation polymerization resin and raw material monomers for an addition polymerization resin, each having an independent reaction path, and carrying out the two polymerization reactions.

7. The toner according to claim 6 wherein the raw material monomers for a condensation polymerization resin are raw material monomers for a polyester, and wherein the raw material monomers for an addition polymerization resin are raw material monomers for a vinyl resin.

8. The toner according to claim 7, wherein the raw material monomers for the polyester comprise an alkylene oxide adduct of bisphenol A as an alcohol component, or a substituted succinic acid of which substituent is an alkyl group or alkeny group as a carboxylic acid component, wherein the alkylene oxide adduct of bisphenol A or the substituted succinic acid is contained in an amount of from 30 to 100% by mol of the alcohol component or the carboxylic acid component, respectively.

9. The toner according to claim 7, wherein the raw material monomers for vinyl resin comprise styrene and/or an alkyl (meth)acrylate in an amount of 50% by weight or more.

10. The toner according to claim 6, wherein the weight ratio of the raw material monomers for a polymerization condensation resin to the raw material monomers for an addition polymerization resin is from 50/50 to 95/5.

11. The toner according to claim 6, further mixing a wax together with the raw material monomers.

12. The toner according to claim 1, wherein the toner is a magnetic toner.

* * * * *